US007334565B2

(12) United States Patent
Hanasato

(10) Patent No.: US 7,334,565 B2
(45) Date of Patent: Feb. 26, 2008

(54) MULTIPLE THROTTLE APPARATUS

(75) Inventor: Maki Hanasato, Odawara (JP)

(73) Assignee: Mikuni Corporation, Tokyo (JP)

( * ) Notice: Subject to any disclaimer, the term of this patent is extended or adjusted under 35 U.S.C. 154(b) by 484 days.

(21) Appl. No.: 10/530,296

(22) PCT Filed: Oct. 10, 2003

(86) PCT No.: PCT/JP03/13033

§ 371 (c)(1),
(2), (4) Date: Apr. 6, 2005

(87) PCT Pub. No.: WO2004/033876

PCT Pub. Date: Apr. 22, 2004

(65) Prior Publication Data

US 2006/0231069 A1 Oct. 19, 2006

(30) Foreign Application Priority Data

Oct. 11, 2002 (JP) ..... 2002-298528

(51) Int. Cl.
*F02D 9/10* (2006.01)
*F02D 10/11* (2006.01)

(52) U.S. Cl. ..... 123/336; 123/337

(58) Field of Classification Search ..... 123/336, 123/337; 251/305, 306
See application file for complete search history.

(56) References Cited

U.S. PATENT DOCUMENTS 6,105,562 A * 8/2000 Akagi et al. ..... 123/580
6,551,156 B2 * 4/2003 Nakamura et al. ..... 440/88 F
2002/0056824 A1 5/2002 Rentschler et al.

FOREIGN PATENT DOCUMENTS

| | | |
|---|---|---|
| JP | 5-40285 | 10/1993 |
| JP | 6-207535 | 7/1994 |
| JP | 8-218904 | 8/1996 |
| JP | 2002-256900 | 9/2002 |

* cited by examiner

*Primary Examiner*—Willis R. Wolfe
*Assistant Examiner*—Johnny H. Hoang

(57) ABSTRACT

According to the present apparatus, there are provided a first throttle body 10 and a second throttle body 10 that define multiple intake passages corresponding to arranged cylinders on one side and on the other side of a V-type engine respectively, a first throttle shaft 31 that simultaneously opens/closes the multiple throttle valves 20 disposed in the first throttle body 10, and a second throttle shaft 32 that simultaneously opens/closes the multiple throttle valves 20 disposed in the second throttle body 10, and a motor 52 and a gear train 52*a*, 53 to 57 are employed as drive means 50 that rotatably drives the first throttle shaft 31 and the second throttle shaft 32. Consequently, open/close operations are synchronously carried out without generating a phase shift. Electronic control is provided for multi-throttle apparatuses applied to V-type engines of two-wheeled vehicles and the like, and the synchronization among throttle valves is secured.

10 Claims, 7 Drawing Sheets

MULTIPLE THROTTLE APPARATUS

TECHNICAL FIELD

The present invention relates to a multi-throttle apparatus which synchronously opens/closes a large number of throttle valves disposed in intake passages of a V-type engine, and more particularly relates to a multi-throttle apparatus including throttle valves respectively disposed in intake passages for respective cylinders of a V-type engine installed on two-wheeled vehicles and the like.

BACKGROUND ART

A throttle apparatus of dual cable/electronic control type, and a throttle apparatus of single electronic control type, for example, have been known as conventional throttle apparatuses applied to engines installed on four-wheeled vehicles.

For example, on an intake system provided with two surge tanks which are used to combine each three intake passages corresponding to respective cylinders on a V-type six-cylinder engine, and intake passages extending upstream from the respective surge tanks, the conventional dual-cable/electronic-controlled throttle apparatus interlocks two throttle valves with each other, which are disposed in the respective upstream intake passages, by means of a single throttle shaft, thereby driving the throttle valves to be opened/closed by means of a cable or a motor (refer to patent document 1, for example).

The conventional electronic-controlled throttle apparatus rotatably combines the throttle valves, which are disposed respectively in the two intake passages formed on the throttle body, by means of a single throttle shaft, thereby driving the throttle valves to be opened/closed by means of a motor disposed on one end of the throttle shaft (refer to patent document 2, for example).

The above-mentioned conventional apparatus is disposed upstream of the surge tanks or upstream of the relatively long intake passages, and the intake air controlled by the opening/closing action of the throttle valves is once accumulated in the surge tanks, or passes through the long intake passages, and is then flowed through the intake passages corresponding to the respective cylinders. Thus, a change in the intake air quantity due to a small variation of the opening/closing operations of the throttle valves, a displacement from the synchronization of the two throttle valves, and the like do not pose serious problems.

On the other hand, as throttle apparatuses for V-type engines installed on two-wheeled vehicles and the like, due to the responsiveness to a throttle operation being emphasized, there has been known a multi-throttle apparatus where throttle valves are disposed respectively in intake passages corresponding to the respective cylinders (intake ports) at a location close to the intake port of a cylinder head, throttle shafts rotatably supporting the respective throttle valves are connected by a synchronization lever, an energizing spring, and the like used for a transmission of the torque, the throttle shafts on the both banks disposed corresponding to the respective arranged cylinders in the V shape are further interlocked via a link mechanism or the like, and a single cable is used to drive all the throttle valves to be opened/closed. In addition, on this apparatus, an independent ISC valve is provided to carry out idle speed control (ISC) of the engine.

[Patent document 1]

Japanese Laid-Open Patent Publication (Kokai) No. H6-207535

[Patent document 2]

Japanese Laid-Open Patent Publication (Kokai) No. H8-218904

It has been studied to provide electronic control which drives multiple throttle valves by means of a motor, and further, control of the idle speed by finely adjusting the opening angle of the throttle valves without an independent ISC valve also on V-type engines installed on two-wheeled vehicles and the like. In addition, the throttle operation on the two-wheeled vehicles is more sensitive than that on four-wheeled vehicles, and is accompanied by rapid changes, and there are thus required a precision in the synchronization corresponding to the sensitivity, high responsiveness following the rapid changes, and the like.

If the above-mentioned conventional throttle apparatuses for four-wheeled vehicles are applied as a throttle apparatus for two-wheeled vehicles and the like, the responsiveness is inferior, and the practicality lacks. Namely, on these apparatuses, a middle portion of the throttle shaft is directly supported by through holes on the throttle bodies or brackets, the friction resistance is thus large on sliding parts, and due to influence of a resistive force of the intake air received by the throttle valves caused by the rapid change, the moment of inertia of the throttle valves, and the like, the throttle shaft may be brought in close contact with the through holes to generate a stick and the like, or the throttle shaft may generate torsion to cause mutual displacements from the synchronization among the throttle valves and the like.

In addition, if a motor is simply installed on the conventional multi-throttle apparatus for two-wheeled vehicles, and electronic control is intended while the rotation angle of the throttle shaft is used as a control parameter, mutual slight displacements from the synchronization (phase shift) among the throttle valves and the like, which are permitted in the conventional cable control, cause obstruction in the realization of the electronic control. Especially, it is necessary to surely prevent the displacements from the synchronization for the control in the case of carrying out the idle speed control by means of the throttle valves without the ISC valve.

The present invention is devised in view of the problems of the above-mentioned prior art, and has an object of providing a multi-throttle apparatus which, upon driving multiple throttle valves respectively disposed in intake passages to be opened/closed, is excellent in responsiveness to rapid changes while synchronizing the respective throttle valves, integrates components, reduces the size, and is preferable for high-performance V-type engines installed especially on two-wheeled vehicles and the like.

DISCLOSURE OF THE INVENTION

A multi-throttle apparatus according to the present invention including a first throttle body that defines multiple intake passages corresponding to arranged cylinders on one side of a V-type engine and a second throttle body that defines multiple intake passages corresponding to arranged cylinders on the other side thereof, multiple throttle valves disposed respectively in the multiple intake passages, a first throttle shaft that supports the multiple throttle valves disposed in the first throttle body to be simultaneously opened/closed, a second throttle shaft that supports the multiple throttle valves disposed in the second throttle body to be simultaneously opened/closed, drive means that rotatably drives the first throttle shaft and the second throttle shaft, and return springs that return the throttle valves to a predetermined angular position, is configured such that the drive means includes a motor disposed between the first throttle shaft and the second throttle shaft, and a gear train that transmits the driving force of the motor to the first throttle shaft and the second throttle shaft, and the first throttle body and the second throttle body include bearings that respectively support the first throttle shaft and the second throttle shaft in mutual intervals of the multiple intake passages.

With this configuration, if the motor drives the throttle shafts, the first throttle shaft for the arranged cylinders on the one side and the second throttle shaft for the arranged cylinders on the other side rotate simultaneously, the multiple throttle valves supported by the respective throttle shafts turn to carry out the open operation against the energizing forces of the return springs, and, on the other hand, if the motor stops, the energizing forces of the return springs cause a reverse rotation to carry out the close operation.

On this occasion, since the first throttle shaft and the second throttle shaft are interlocked with each other through the gear train, no phase shift is generated compared with a case where a link mechanism or the like is used, and the synchronization between them is thus secured. The respective throttle valves thus are synchronized without generating a phase shift, follow rapid changes, and operate smoothly.

Moreover, since the motor is disposed between the first throttle shaft and the second throttle shaft, the apparatus can be integrated while the distribution of the driving force is equalized, and both of the throttle shafts are supported by the bearings in the mutual intervals between the intake passages, the torsions of both of the throttle shafts are surely prevented, the respective throttle valves are synchronously opened/closed without generating a phase shift, properly follow rapid changes respectively, and operate smoothly.

The above-mentioned configuration may employ such a configuration that the gear train is disposed on ends on the same side of the first throttle shaft and second throttle shaft.

With this configuration, the drive means can be integrated on the one side of the apparatus, and the width and the size of the entire apparatus can be reduced.

The above-mentioned configuration may employ such a configuration that the gear train includes a gear train that transmits the driving force of the motor to one end of the first throttle shaft, and a gear train that interlocks the second throttle shaft with the first throttle shaft on the other end of the first throttle shaft.

With this configuration, since the driving force is transmitted to the first throttle shaft and the second throttle shaft equally on the left and right sides, the transmission loss of the torque can be reduced. If both of the throttle shafts are driven in the mutually opposite directions, it is possible to eliminate gears such as an idler.

The above-mentioned configurations may employ such a configuration that the throttle bodies (first throttle body and second throttle body) include multiple throttle bodies that respectively define the multiple intake passages, and are connected to each other in the direction in which the throttle shafts (first throttle shaft and second throttle shaft) extend, and the multiple throttle bodies include an engagement section that engages the bearing.

With this configuration, it is possible to readily dispose the bearings in the mutual intervals between the intake passages by connecting the respective throttle bodies after the bearings are engaged with the engagement sections, thereby forming the first throttle body and the second throttle body.

The above-mentioned configuration may employ such a configuration that the multiple throttle bodies are connected with each other via a spacer that adjusts the mutually separated distance.

With this configuration, even if the mutual distances between the engine cylinders (intake ports) are different from each other, the multi-throttle apparatus can be readily configured corresponding to various engines by properly adjusting the length of the spacers.

The above-mentioned configuration may employ such a configuration that the spacers are formed so as to fix the bearings to the throttle bodies.

With this configuration, it is not necessary to employ a dedicated component used to fix the bearings, thereby simplifying the structure.

The above-mentioned configurations may employ such a configuration that the multiple throttle valves are formed such that the cross section thereof tapers off to the tip thereof as departed from the rotation center.

With this configuration, the moments of inertia of the throttle valves decrease, and the response to rapid changes increases, and the torsion of the throttle shafts is prevented more surely.

BEST MODE FOR CARRYING OUT THE INVENTION

A description will now be given of embodiments of the present invention with reference to accompanying drawings.

Figure 1:
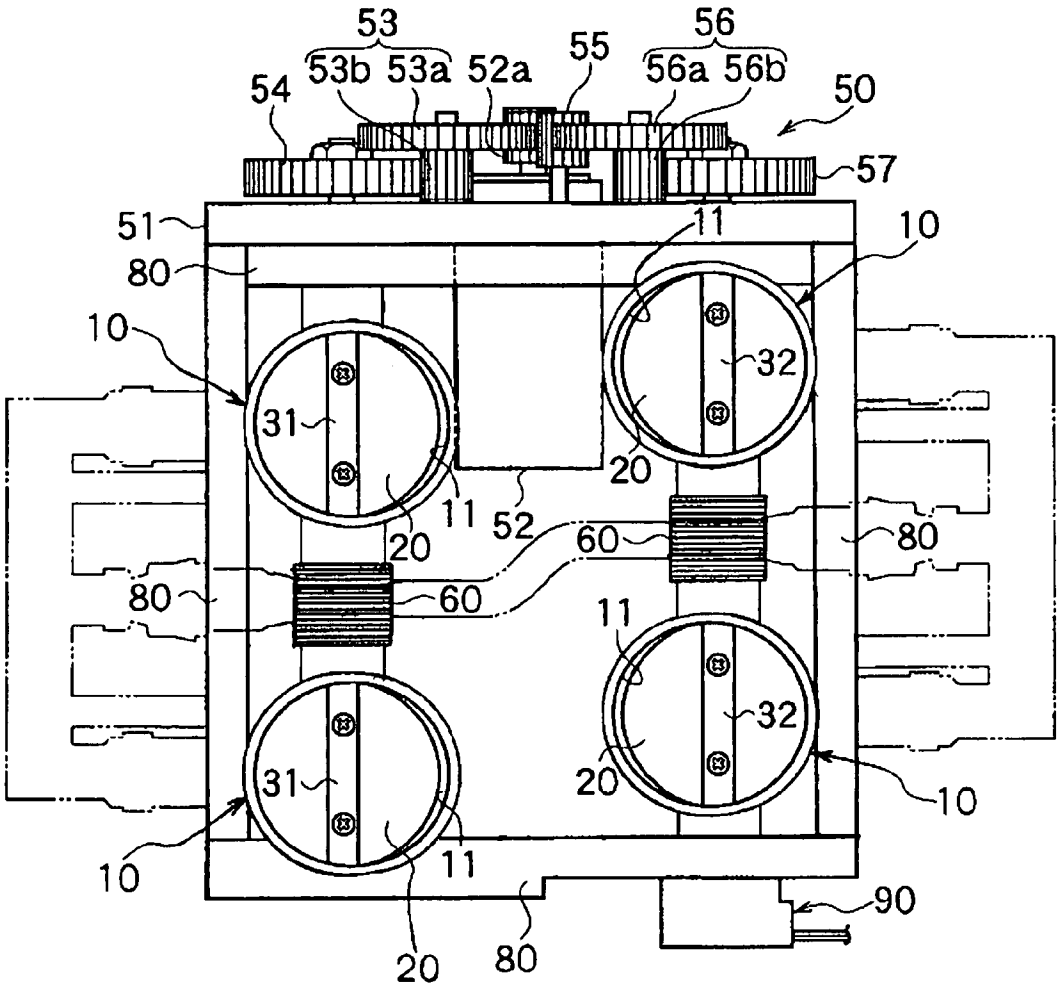
FIG. 1 is a plan view showing an embodiment of a multi-throttle apparatus according to the present invention.
Figure 2:
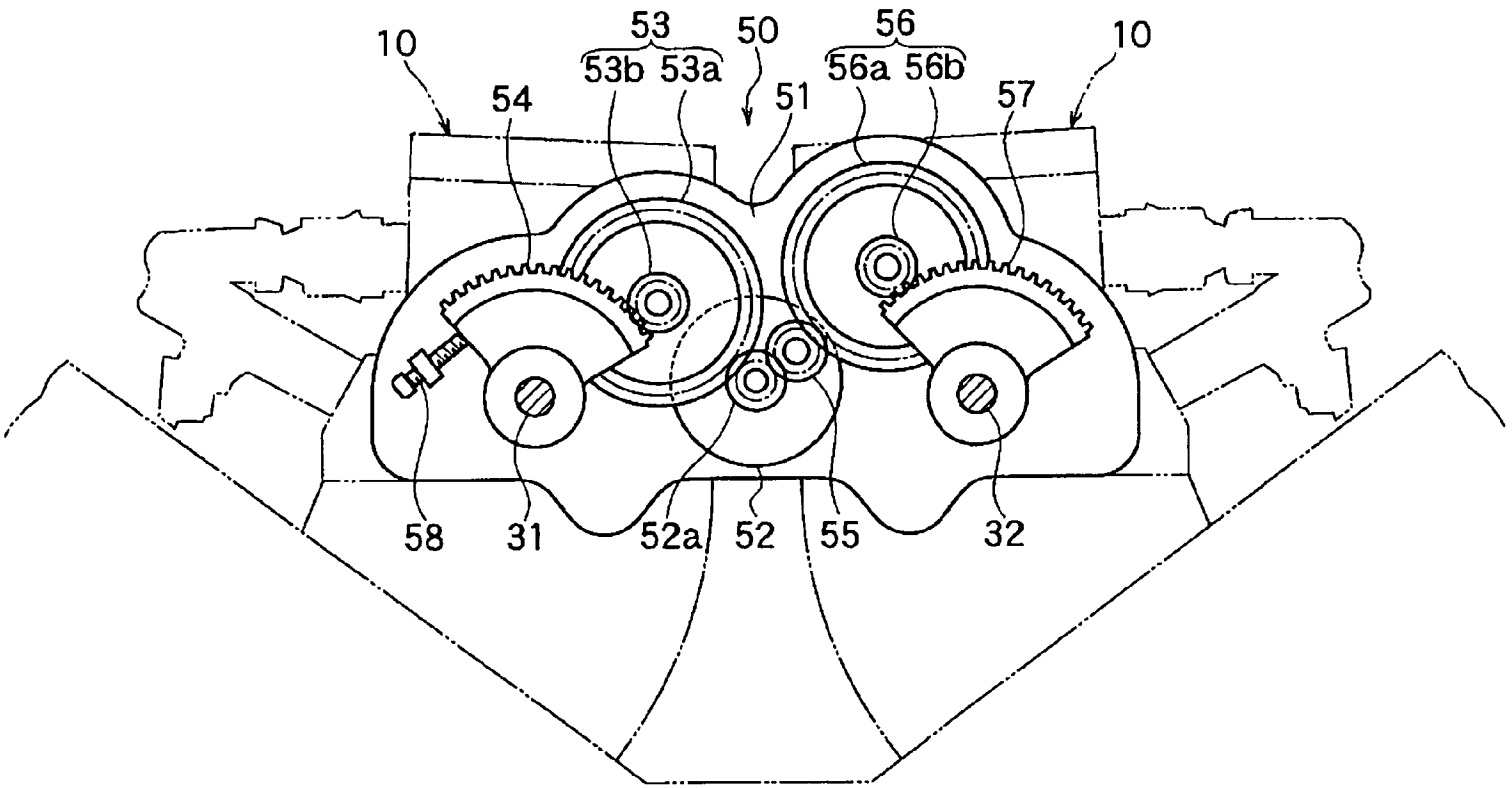
FIG. 2 is a side view showing drive means of the apparatus shown in FIG. 1.
Figure 3:
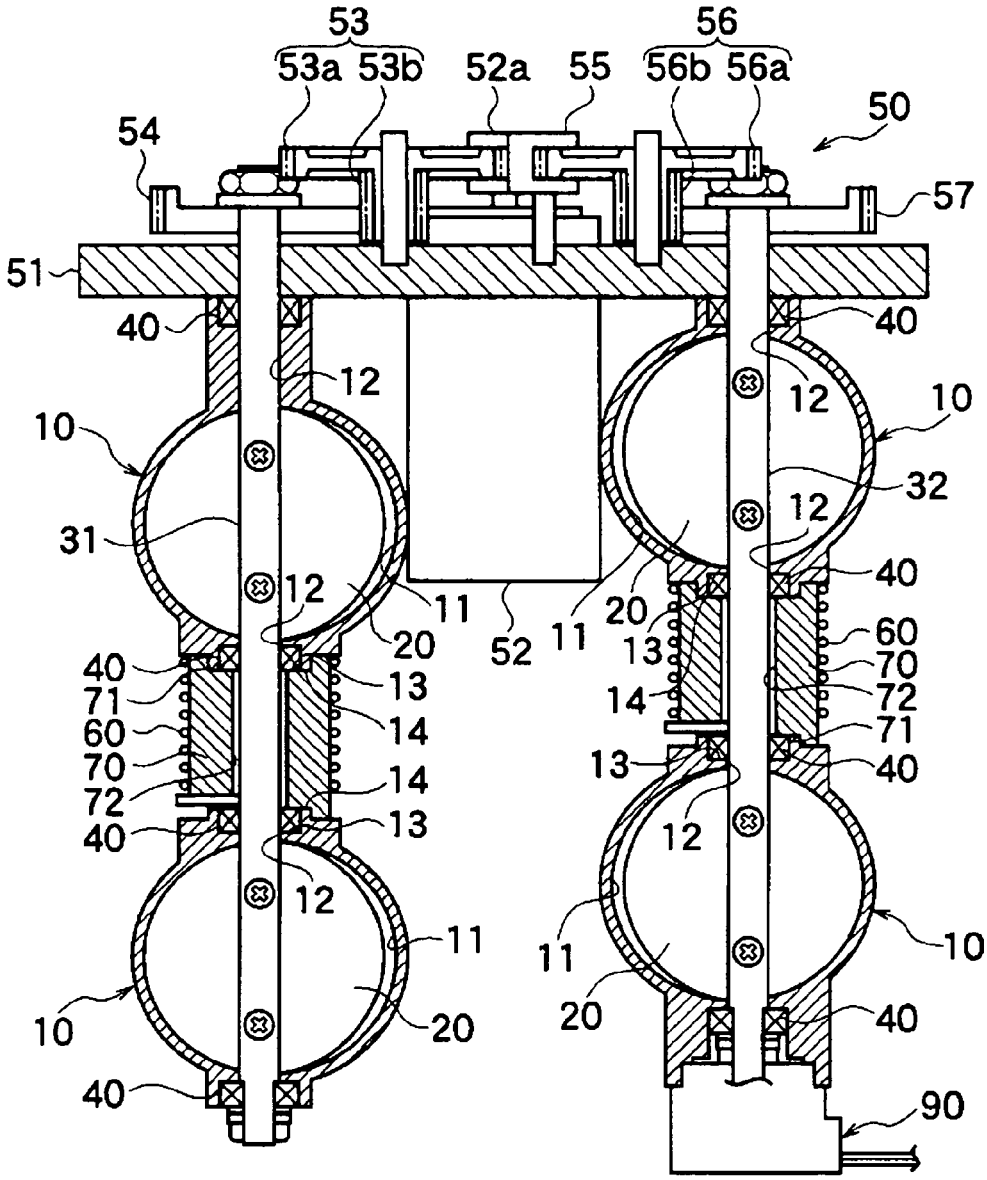
FIG. 3 is a plan sectional view showing a periphery of throttle shafts and throttle valves of the apparatus shown in FIG. 1.
Figure 4:
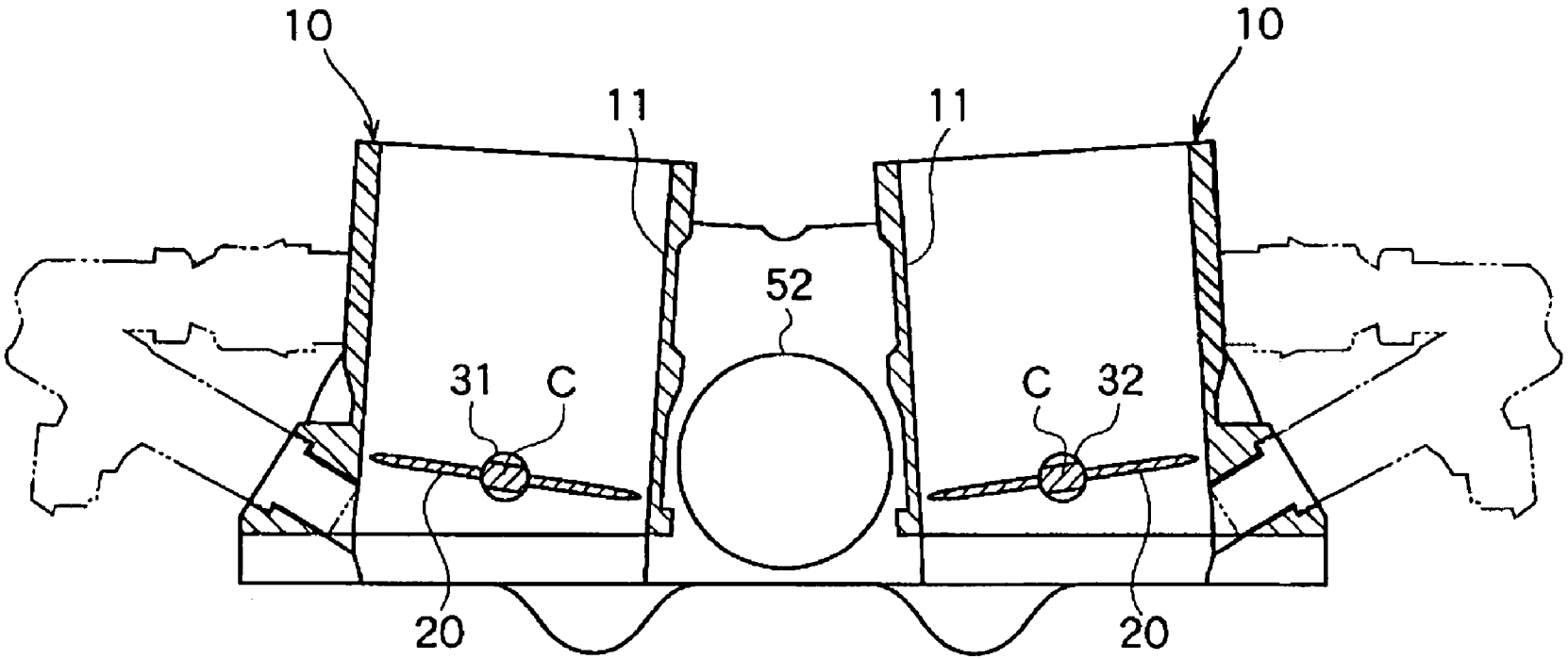
FIG. 4 is a side sectional view showing the throttle valves of the apparatus shown in FIG. 1.

FIGS. 1 to 4 show an embodiment of a multi-throttle apparatus according to the present invention, FIG. 1 is plan view showing the schematic configuration, FIG. 2 is a side view of drive means, FIG. 3 is a plan sectional view showing a periphery of throttle shafts, and FIG. 4 is a side sectional view showing throttle valves.

This apparatus is a four-throttle apparatus applied to a V-type four-cylinder engine installed on two-wheeled vehicles, and, as shown in FIG. 1, is provided with two throttle bodies 10 that define intake passages 11, and form a first throttle body attached to arranged cylinders on the left side (one side), two throttle bodies 10 that form a second throttle body attached to arranged cylinders on the right side (the other side), four throttle valves 20 that are disposed in the respective intake passages 11, a first throttle shaft 31 that rotatably supports the two throttle valves 20 disposed in the first throttle body so as to simultaneously close/open them, a second throttle shaft 32 that rotatably supports the two throttle valves 20 disposed in the second throttle body so as to simultaneously close/open them, bearings 40 that respectively and rotatably support both the throttle shafts 31, 32, drive means 50 that applies a rotational driving force to the throttle shafts 31, 32, return springs 60 that return the throttle valves 20 to a predetermined angular position, spacers 70 that are disposed in the mutual intervals between the throttle bodies 10, connection frames 80 that connect the four throttle bodies 10, an angle detection sensor 90 that detects the rotation angle of the second throttle shaft 32, and the like.

The throttle body 10 is molded by means of die forming using an aluminum material or resin material, and, as shown in FIG. 1 to FIG. 3, is formed by the intake passage 11 that has an approximately circular section, through holes 12 that pass the throttle shaft 31 or 32, engagement sections 13 in a recessed shape that engage the bearings 40, joint protrusions 14, and the like.

The through holes 12 are formed slightly larger than the outer diameter of the throttle shafts 31, 32 to achieve a non-contact state, and the throttle shafts 31, 32 are supported only by the bearings 40.

The throttle valve 20 is molded by means of die forming using an aluminum material or resin material, and, as shown in FIG. 4, is formed such that the cross section thereof tapers off to the tip thereof as departed from the rotation center C increases. The throttle valves 20 are fixed to the throttle shafts 31, 32 by means of screws or the like.

Forming the throttle valves 20 in the shape tapering off to the tip in this way reduces the moment of inertia, increases the responsiveness of the opening/closing operations, and contributes to the prevention of the torsion of the throttle shafts 31, 32.

As shown in FIG. 3, the bearings 40 are engaged with the engagement sections 13 of the throttle bodies 10, are disposed on both sides mutual intervals between the intake passages 11 (in the areas of the spacers 70).

Even if a resistive force of the intake air generated by the rapid opening/closing operations and the like is applied to deflect middle areas of the throttle shafts 31, 32 via the throttle valves 20, for example, since the middle areas are supported by the bearings 40, a smooth rotation is provided without generating a stick and the like.

Consequently, the torsion of the throttle shafts 31, 32 and the like are prevented, and the synchronization of the throttle valves 20 (opening/closing operations in phase) is secured.

Note that various bearings such as ball bearings, roller bearings, and cylindrical bearings whose contact face itself provides a bearing function, may be employed as the bearing 40. In addition, bearings which provide supports in the thrust direction in addition to the radial direction are employed as at least a part of the multiple bearings 40.

As shown in FIGS. 1 to 3, the drive means 50 is disposed so as to apply the driving force to the ends on the same side of the first throttle shaft 31 and the second throttle shaft 32, and is formed by a holding plate 51 that is fixed to the throttle bodies 10 and the connection plate 80, a DC motor 52 that is disposed between the first throttle shaft 31 and the second throttle shaft 32, is fixed to the holding plate 51, and includes a pinion 52*a*, a gear train that includes a gear 53 (large gear 53*a* and small gear 53*b*) that is rotatably supported by the supporting plate 51, and meshes with the pinion 52*a*, a gear 54 that is fixed to the first throttle shaft 31, and meshes with the gear 53 (small gear 53*b*), a gear 55 that is rotatably supported by the holding plate 51, and meshes with the pinion 52*a*, a gear 56 (large gear 56*a* and small gear 56*b*) that meshes with the gear 55, a gear 57 that is fixed to the second throttle shaft 32, and meshes with the gear 56 (small gear 56*b*), and the like.

Namely, if the DC motor 52 rotates, the rotational driving force thereof is transmitted from the pinion 52*a* to the first throttle shaft 31 via the gears 53, 54, and is transmitted from the pinion 52*a* to the second throttle shaft 32 via the gears 55, 56, 57, and the first throttle shaft 31 and the second throttle shaft 32 rotate in the mutually opposite directions to drive the throttle valves 20 to be opened/closed.

Since the driving force is transmitted via the gear train in this way, compared with a case where the transmission is carried out via a link mechanism or the like, a phase shift between both the throttle shafts 31, 32 is prevented, the mutual synchronization of the throttle valves 20 supported by the throttle shafts 31, 32 is secured, and the four throttle valves 20 carry out the open/close operations in phase.

Moreover, the arrangement of the drive means 50 on the one end of the apparatus, especially the arrangement of the DC motor 52 between the first throttle shaft 31 and the second throttle shaft 32, integrates the drive means 50, thereby integrating the apparatus, and thus reducing the widthwise dimension, especially restraining protrusions in the widthwise direction upon being installed on a two-wheeled vehicle, and it is thus possible to prevent the apparatus from hitting the ground and the like upon the vehicle falling and the like, and consequently being damaged.

It should be noted that on the holding plate 51 is provided an adjust screw 58 which restricts a stop position of the gear 54, namely a rest position of the throttle valves 20, and an appropriate adjustment of the adjust screw 58 sets the opening of the throttle valves 20 in the rest state to a desired value.

The return springs 60 are torsion springs disposed around the spacers 70 as shown in FIG. 3, and apply a rotational energizing force to the throttle shafts 31, 32 to return the throttle valves 20 to the predetermined angular position. It should be noted that the return springs 60 may be disposed close to the drive means 50. In this case, the energizing forces are applied close to the driving force, the torsion of the respective throttle shafts 31, 32 is prevented as much as possible, and the mutual synchronization of the throttle valves 20 supported by the respective throttle shafts 31, 32 is secured.

Although only one spring is used for the respective throttle shafts 31, 32 as the return spring 60 in this case, multiple return springs generating energizing forces different from each other may be disposed along the respective throttle shafts 31, 32, a return spring which applies the largest energizing force may be disposed close to the location to which the driving force is applied, and the other return springs may be disposed so as to gradually decrease the energizing force toward the other end of the throttle shafts 31, 32. In this case, the torsion of the throttle shafts 31, 32 is prevented, and the return operation becomes smoother.

The spacers 70 connect the throttle bodies 10 with each other in the extension direction of the throttle shafts 31, 32 as shown in FIG. 3. The spacers 70 are formed into a cylindrical shape, and include joint recesses 71 that engage the joint protrusions 14 of the throttle bodies 10, a through passage 72 that passes the throttle shaft 31 or 32 without contact, positioning sections (not shown) that mutually position the joined throttle bodies 10, and the like. The end surfaces of the through passage 72 are formed to push and fix the bearings 40 engaged to the engagement sections 13. An independent component used to fix the bearing 40 is thus not necessary.

If the spacer 70 is used to connect the throttle bodies 10 with each other, the bearings 40 are first installed to the engagement sections 13 of the throttle bodies 10, the throttle bodies 10 are then mutually joined and connected on both sides of the spacer 70, and the connection plate 80 firmly fixes the throttle bodies 10 to each other.

On this occasion, a proper change of the length of the spacer 70 enables application to various engines different in the mutual separated distance between the intake passages 11.

The angle detection sensor 90 is a non-contact angle sensor disposed on the end of the second throttle shaft 32 as shown in FIG. 1 and FIG. 3, detects the rotation angle position of the second throttle shaft 32 (namely the rotation angle position of the throttle valves 20), and outputs a resulting detection signal to a control unit. The control unit transmits a drive signal to the DC motor 52 based on the detection signal, and controls the opening of the throttle valves 20 according to a control mode.

A description will now be given of the operation of the above-mentioned multi-throttle apparatus.

The DC motor 52 rotates in one direction based on the control signal transmitted from the control unit, and the rotational driving force is transmitted to the first throttle shaft 31 and the second throttle shaft 32 via the gear train 52*a*, 53, 54, and the gear train 52*a*, 55, 56, 57.

The first throttle shaft 31 and the second throttle shaft 32 then start rotating in the mutually opposite directions against the energizing forces of the return springs 60, and the throttle valves 20 rotate from the rest position to the position to fully open the intake passages 11.

On this occasion, since the throttle shafts 31, 32 are supported by the bearings 40 in mutual intermediate areas between the intake passages 11 as well, and the throttle valves 20 are further formed to taper off to the tip thereof to decrease the moment of inertia, the throttle shafts 31, 32 rotate smoothly, thereby preventing the torsion thereof. Consequently, the throttle valves 20 supported by the respective throttle shafts 31, 32 are synchronously opened/closed without generating mutual phase shifts.

On the other hand, if the DC motor 52 rotates in the opposite direction based on the control signal from the control unit, the throttle shafts 31, 32 rotate in the opposite direction while the energizing forces of the return springs 60 are applied, and the throttle valves 20 rotate from the fully open position to the rest position, which closes the intake passages 11. In the normal operation, the rotation of the DC motor 52 is properly controlled according to the control mode, and the throttle valves 20 are driven to be opened/closed to attain an optimal opening. If the DC motor 52 stops, the throttle shafts 31, 32 are quickly rotated by the energizing forces of the return springs 60 to return the throttle valves 20 to the rest position.

If the idle speed control is carried out by means of the throttle valves 20, the DC motor 52 is properly driven based on the drive signal from the control unit, and the throttle shafts 31, 32, namely the opening of the throttle valves 20 is finely adjusted. Since the mutual synchronization of the throttle valves 20 is secured upon carrying out the ISC drive in this way, highly precise control is enabled.

Figure 5:
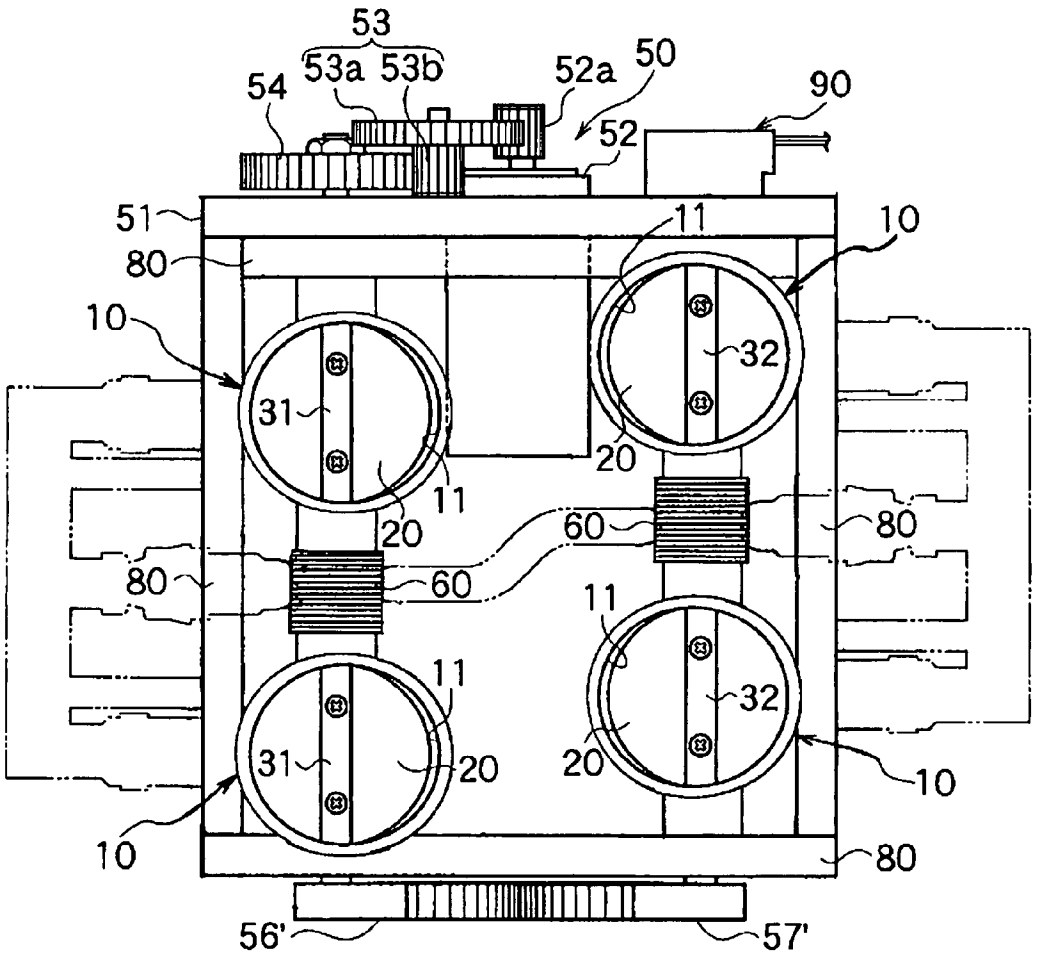
FIG. 5 is a plan view showing another embodiment of the multi-throttle apparatus according to the present invention.
Figure 6:
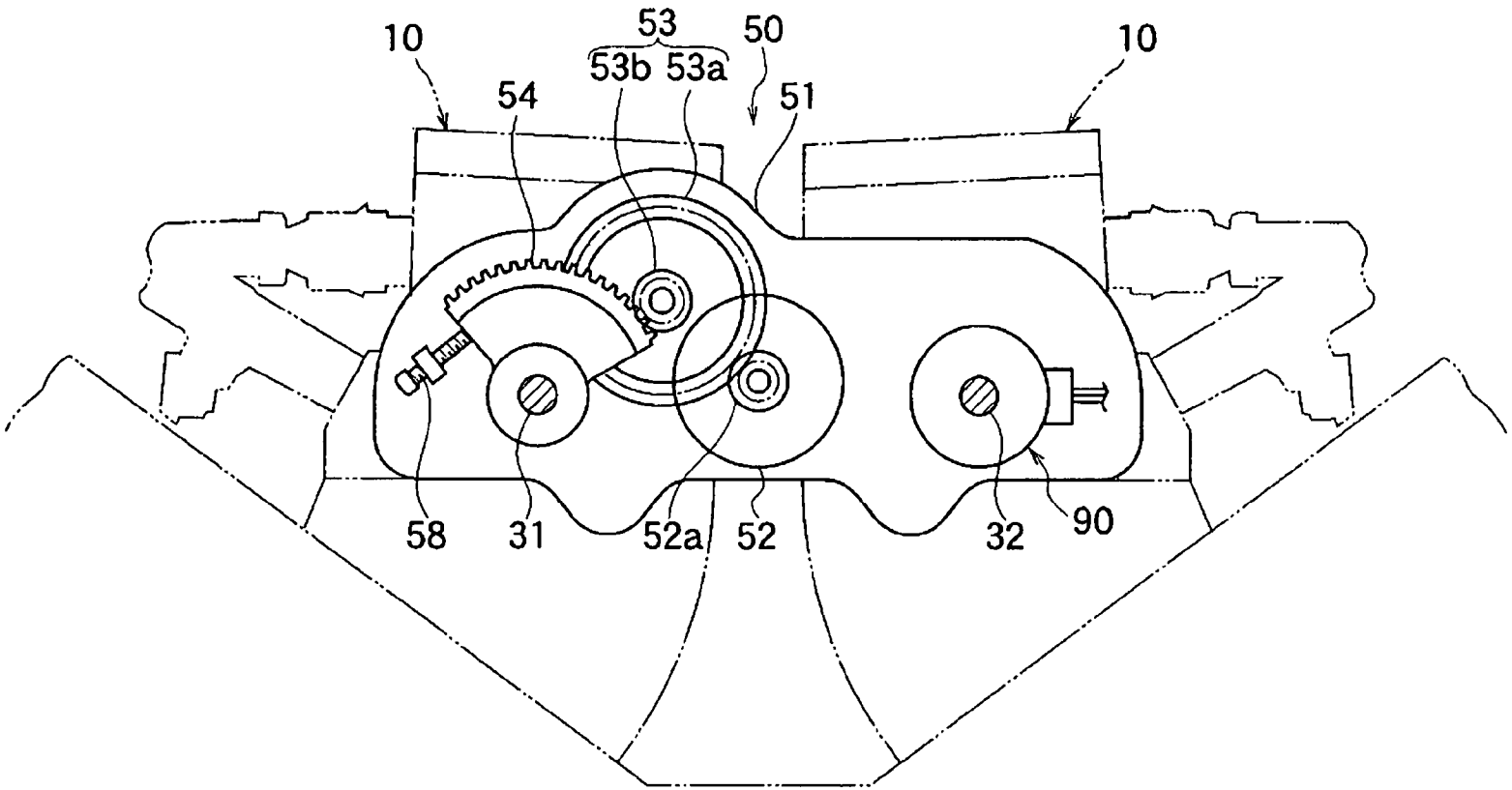
FIG. 6 is a side view showing drive means of the apparatus shown in FIG. 5.

FIG. 5 and FIG. 6 show another embodiment of the multi-throttle apparatus according to the present invention, and is the same as the above-mentioned embodiment except that the disposition of the drive means 50 is changed. In the present embodiment, like components are denoted by like numerals as of the above-mentioned embodiment, and will be explained in no more details.

Figure 7:
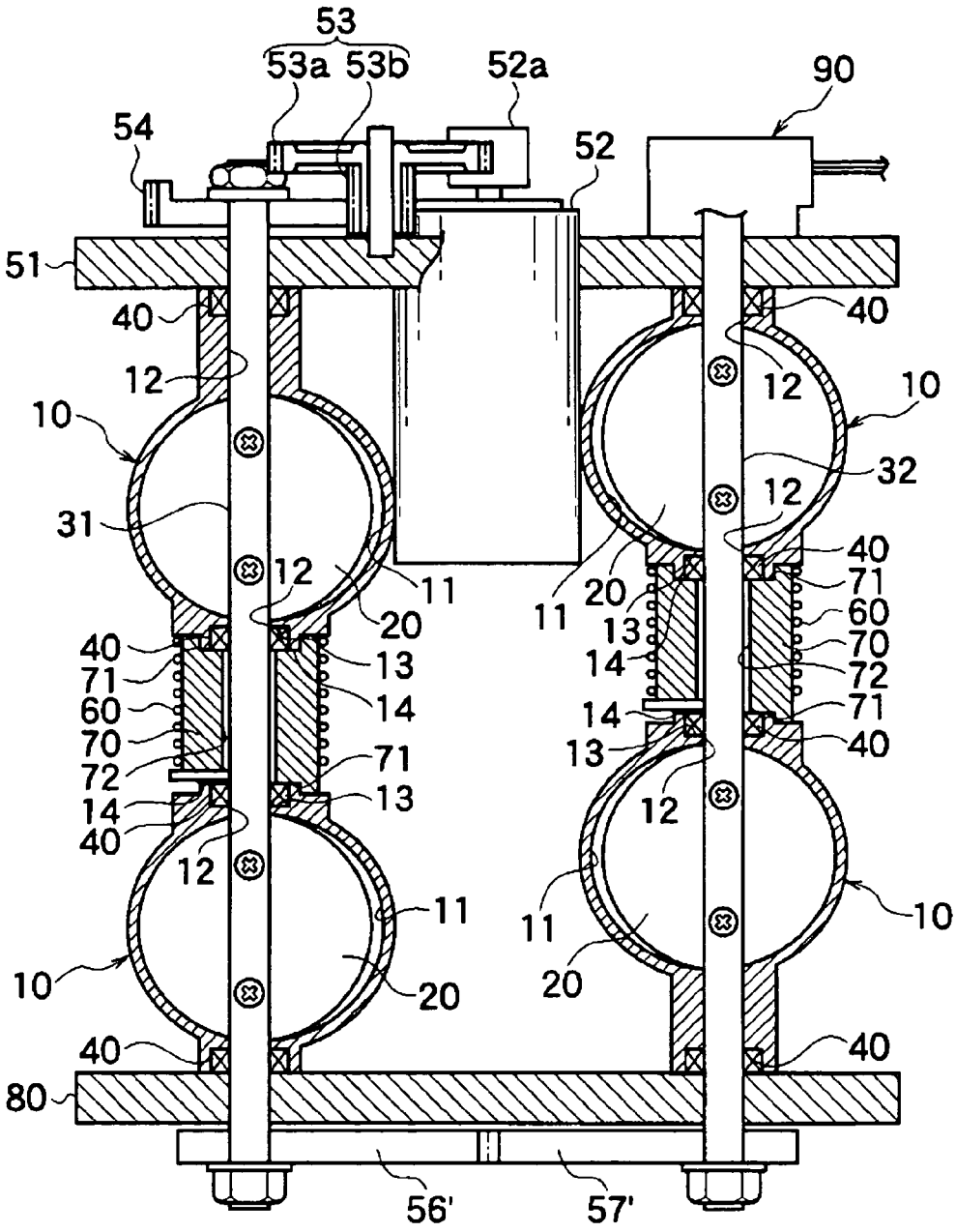
FIG. 7 is a plan sectional view showing a periphery of throttle shafts and throttle valves of the apparatus shown in FIG. 5.

On this apparatus, as shown in FIG. 5 to FIG. 7, the driving force of the motor 52 is first transmitted to the first throttle shaft 31, and a driving force of the first throttle shaft 31 is then transmitted to the second throttle shaft 32.

Namely, on a section on the one side of the apparatus are disposed the motor 52 including the pinion 52*a*, the gear 53, and the gear 54 that is fixed to the one end of the first throttle shaft 31. On a section on the other side of the apparatus are disposed a gear 56' that is fixed to the other end of the first throttle shaft 31, and a gear 57' that is fixed to one end of the second throttle shaft 32, and meshes with the gear 56'.

On the other end of the second throttle shaft 32 (in a section on the one side of the apparatus) is disposed the angle detection sensor 90.

With this arranged configuration, the gear 55 serving as the idler in the above-mentioned embodiment can be eliminated, thereby reducing the corresponding number of the component items.

A description will now be given of the operation of the above-mentioned multi-throttle apparatus.

If the DC motor 52 rotates in one direction based on a control signal transmitted from a control unit, the rotational driving force is first transmitted to the first throttle shaft 31 via the gear train 52*a*, 53, 54, and the rotational force of the first throttle shaft 31 is then transmitted to the second throttle shaft 32 via the gears 56', 57' on the opposite side.

The first throttle shaft 31 and the second throttle shaft 32 then start rotating in the mutually opposite directions against the energizing forces of the return springs 60, and the throttle valves 20 rotate from the rest position to the position to fully open the intake passages 11.

With this configuration, since the driving force is transmitted to the first throttle shaft 31 and the second throttle shaft 32 equally on both the sides, the transmission loss of the torque can be reduced.

As in the above-mentioned embodiment, since the throttle shafts 31, 32 are supported by the bearings 40 in mutual intermediate areas between the intake passages 11 as well, and the throttle valves 20 are further formed to taper off to the tip thereof to decrease the moment of inertia, the throttle shafts 31, 32 rotate smoothly, thereby preventing the torsion thereof. Consequently, the throttle valves 20 supported by the respective throttle shafts 31, 32 are synchronously opened/closed without generating mutual phase shifts.

On the other hand, if the DC motor 52 rotates in the opposite direction based on the control signal from the control unit, the first throttle shaft 31 rotates in the opposite direction, and the second throttle shaft 32 simultaneously rotates in the opposite direction in an interlocking manner while the energizing forces of the return springs 60 are applied, and the throttle valves 20 rotate from the fully open position to the rest position, which closes the intake passages 11. In the normal operation, the rotation of the DC motor 52 is properly controlled according to the control mode, and the throttle valves 20 are driven to be opened/closed to attain an optimal opening. If the DC motor 52 stops, the throttle shafts 31, 32 are quickly rotated by the energizing forces of the return springs 60 to return the throttle valves 20 to the rest position.

Although the description is given of the four-throttle apparatus in the above-mentioned embodiments as the multi-throttle apparatus, the configuration of the present invention is not limited to this example, and may be employed in multi-throttle apparatuses such as a fivethrottle, where two throttles for the arranged cylinders on one side and three throttles for the arranged cylinders on the other side, or six or more-throttle apparatus.

Although the spacers 70 are used to connect the multiple throttle bodies 10 in the above-mentioned embodiments, the throttle bodies 10 may be directly joined for the connection without using the spacers 70. Although the description is given of the multiple throttle bodies 10 formed independently, an integrally formed throttle bodies may be employed as long as the bearings 40 can be fitted.

Further, although the description is given of the high-performance V-type engines installed on the two-wheeled vehicles as the engines to which the multi-throttle apparatus according to the present invention is applied in the above-mentioned embodiments, the engines are not limited to this type, and the present invention may be applied to V-type engines installed on other vehicles such as automobiles.

INDUSTRIAL APPLICABILITY

As described above, with the multi-throttle apparatus according to the present invention, for the first throttle body and the second throttle body disposed respectively for the arranged cylinders on the one side and the arranged cylinders on the other side of a V-type engine, since the first throttle shaft and the second throttle shaft which rotatably support the throttle valves are synchronously driven by the drive means including a motor and gear trains, the phase shift is reduced, and the synchronization between them is secured compared with the case where a link mechanism or the like is used to drive. As a result, the respective throttle valves do not generate the phase shift, are synchronously opened/closed, and follow quick changes with proper responsiveness to operate smoothly.

The invention claimed is:

1. A multi-throttle apparatus comprising:

a first throttle body that defines a plurality of intake passages corresponding to arranged cylinders on one side of a V-type engine respectively;

a second throttle body that defines a plurality of intake passages corresponding to arranged cylinders on the other side thereof respectively;

a plurality of throttle valves disposed respectively in said plurality of intake passages;

a first throttle shaft that supports said plurality of throttle valves disposed in said first throttle body to be simultaneously opened/closed;

a second throttle shaft that supports said plurality of throttle valves disposed in said second throttle body to be simultaneously opened/closed;

a drive means for rotatably driving said first throttle shaft and said second throttle shaft; and a return spring that returns said throttle valves to a predetermined angular position, wherein said drive means comprises a motor disposed between said first throttle shaft and said second throttle shaft, and a gear train that transmits a driving force of said motor to said first throttle shaft and second throttle shaft, and said first throttle body and said second throttle body include bearings which respectively support said first throttle shaft and said second throttle shaft in mutual intervals between said plurality of intake passages.

2. The multi-throttle apparatus according to claim 1, wherein said gear train is disposed on ends on the same side of said first throttle shaft and said second throttle shaft.

3. The multi-throttle apparatus according to claim 1, wherein said gear train comprises a gear train that transmits the driving force of said motor to one end of said first throttle shaft, and a gear train that interlocks said second throttle shaft with said first throttle shaft on the other end of said first throttle shaft.

4. The multi-throttle apparatus according to claim 1, 2 or 3, wherein said throttle body comprises a plurality of throttle bodies that respectively define said plurality of intake passages, and are connected to each other in the direction in which said throttle shaft extends, and said plurality of throttle bodies comprise an engagement section that engages said bearing.

5. The multi-throttle apparatus according to claim 4, wherein said plurality of throttle bodies are connected with each ether via a spacer that adjusts the mutual separated distance.

6. The multi-throttle apparatus according to claim 5, wherein said spacer is formed so as to fix said bearing to said throttle body.

7. The multi-throttle apparatus according to claim 6, wherein said plurality of throttle valves are formed such that the cross section thereof tapers off to the tip thereof as departed from the rotation center.

8. The multi-throttle apparatus according to claim 5, wherein said plurality of throttle valves are formed such that the cross section thereof tapers off to the tip thereof as departed from the rotation center.

9. The multi-throttle apparatus according to claim 4, wherein said plurality of throttle valves are formed such that the cross section thereof tapers off to the tip thereof as departed from the rotation center.

10. The multi-throttle apparatus according to claim 1 or 2, wherein said plurality of throttle valves are formed such that the cross section thereof tapers off to the tip thereof as departed from the rotation center.

* * * * *

UNITED STATES PATENT AND TRADEMARK OFFICE

CERTIFICATE OF CORRECTION

PATENT NO. : 7,334,565 B2
APPLICATION NO. : 10/530296
DATED : February 26, 2008
INVENTOR(S) : Maki Hanasato It is certified that error appears in the above-identified patent and that said Letters Patent is hereby corrected as shown below:

Column 10, Line 30, change “ether” to --other--.

Signed and Sealed this

Second Day of September, 2008

JON W. DUDAS
*Director of the United States Patent and Trademark Office*